US005281048A

United States Patent [19]

Hagenah

[11] Patent Number: 5,281,048

[45] Date of Patent: Jan. 25, 1994

[54] PLATE-SHAPED CONCRETE BLOCK AND PROCESS AND DEVICE FOR THE MANUFACTURE OF THE SAME

[75] Inventor: Gerhard Hagenah, Worpswede, Fed. Rep. of Germany

[73] Assignee: SF-Vollverbundstein-Kooperation GmbH, Fed. Rep. of Germany

[21] Appl. No.: 844,599

[22] PCT Filed: Oct. 5, 1990

[86] PCT No.: PCT/EP90/01672

§ 371 Date: May 19, 1992

§ 102(e) Date: May 19, 1992

[87] PCT Pub. No.: WO91/05111

PCT Pub. Date: Apr. 18, 1991

[30] Foreign Application Priority Data

Oct. 6, 1989 [DE] Fed. Rep. of Germany ..... 3933413

[51] Int. Cl.[5] ..... E01C 5/00

[52] U.S. Cl. ..... 404/44; 404/34

[58] Field of Search ..... 404/34, 44; 52/144, 52/145, 605-607

[56] References Cited

U.S. PATENT DOCUMENTS

| | | | |
|---|---|---|---|
| 364,928 | 6/1887 | Hoyt | 404/34 |
| 2,662,343 | 12/1953 | Rice . | |
| 4,210,698 | 7/1980 | Watson | 404/44 X |

FOREIGN PATENT DOCUMENTS

| | | |
|---|---|---|
| 28238 | 12/1982 | European Pat. Off. . |
| 1917844 | 6/1965 | Fed. Rep. of Germany . |
| 1926754 | 11/1965 | Fed. Rep. of Germany . |
| 53090 | 1/1967 | Fed. Rep. of Germany . |
| 1914159 | 12/1973 | Fed. Rep. of Germany . |
| 7520196 | 11/1975 | Fed. Rep. of Germany . |
| 7522311 | 1/1976 | Fed. Rep. of Germany . |
| 2533800 | 2/1977 | Fed. Rep. of Germany . |
| 2900939 | 1/1980 | Fed. Rep. of Germany . |
| 2901109 | 7/1980 | Fed. Rep. of Germany . |
| 3331137 | 3/1985 | Fed. Rep. of Germany . |
| 3712461 | 10/1987 | Fed. Rep. of Germany . |
| 3909169 | 10/1989 | Fed. Rep. of Germany . |
| 389310 | 9/1908 | France . |
| 2190137 | 1/1974 | France . |
| 2493214 | 12/1981 | France . |
| 22830 | of 1901 | United Kingdom . |
| 199694 | 8/1923 | United Kingdom . |

*Primary Examiner*—Thuy M. Bui

*Attorney, Agent, or Firm*—Sughrue, Mion, Zinn, Macpeak & Seas

[57] ABSTRACT

In the case of earth coverings made from concrete paving slabs, the noise generated by rolling traffic is disadvantageous. In order to reduce the generation of noise, plate-shaped concrete blocks exhibiting a significantly larger format than traditional paving slabs are proposed. The top side of the concrete blocks consists of a sound absorption layer (13) of porous concrete. On the bottom side, the concrete block is curved inwards, so that the fringe areas are subjected to a higher load. This results in a stable situation. For the purpose of draining off the surface water, the concrete block is equipped at the sides with upright slots (16), which adjoin the absorption layer (13) of porous concrete.

11 Claims, 4 Drawing Sheets

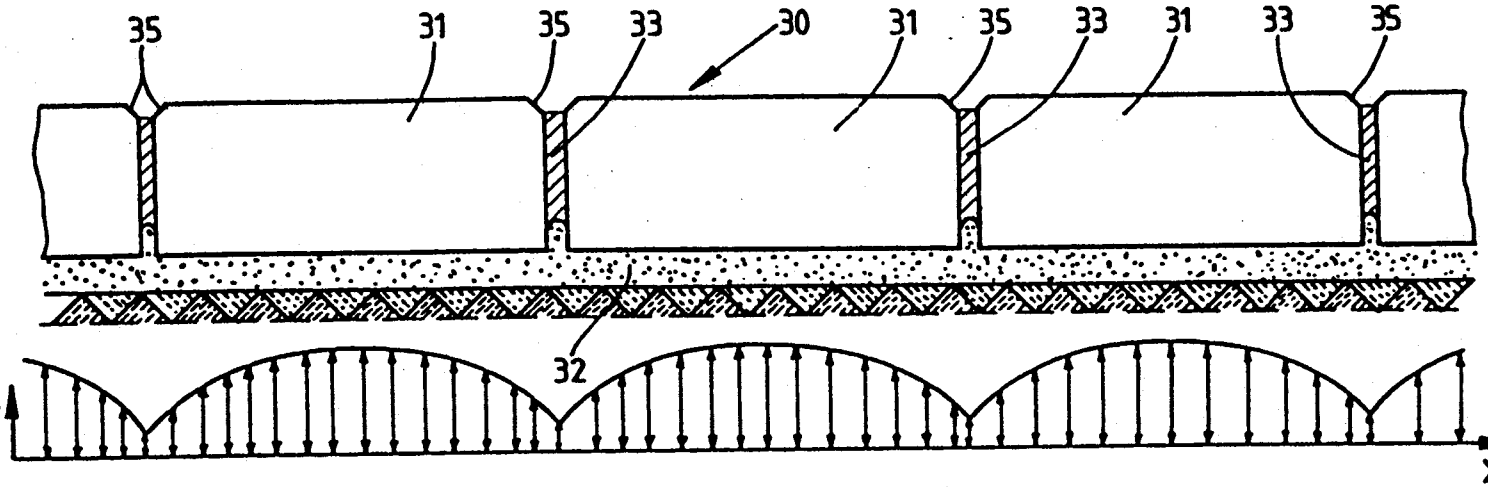
Fig. 6A
Fig. 6B
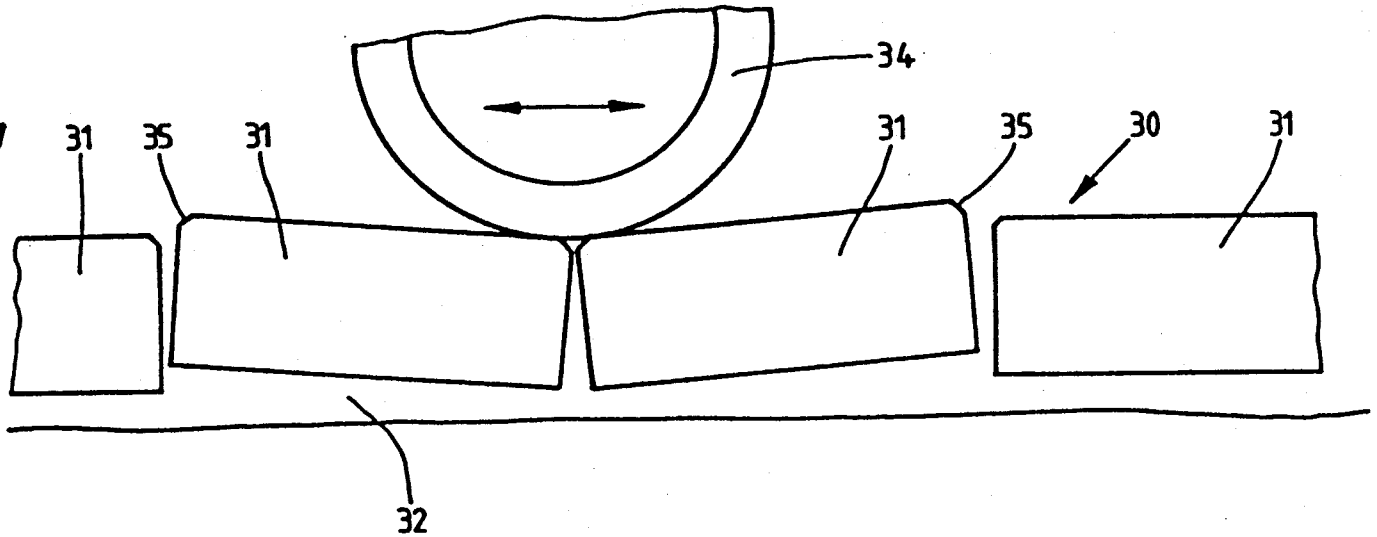
Fig. 7

PLATE-SHAPED CONCRETE BLOCK AND PROCESS AND DEVICE FOR THE MANUFACTURE OF THE SAME

BACKGROUND OF THE INVENTION

The invention relates to a plate-shaped concrete block for covering roads, paths and squares.

Concrete blocks or paving slabs, as an earth covering for roads, paths and squares, are superior in a number of respects to black top pavings and other associated coverings. However, the generation of noise in rolling traffic (by vehicles) is seen as a disadvantage.

SUMMARY OF THE INVENTION

The object the invention is to propose a paving slab or concrete block which, whilst maintaining the advantages of paving slabs as an earth covering, significantly reduce the generation of noise caused by rolling traffic.

In order to achieve this object, the plate-shaped concrete block according to the invention is characterised by the following features:

a) a sound-absorbing absorption layer 13 of porous concrete is disposed on a block element 12 made from (heavy) concrete, b) the top side of the absorption layer 13 is level, the bottom side and accordingly the top side of the block element 12 is of curved configuration, the absorption layer 13 exhibiting greater thickness at the fringes of the block.

c) the block element 12 is equipped on its bottom side with a curvature 18, such that the concrete block is configured to exhibit a greater height at the fringes of the block.

The invention is based on the recognition that a significant reduction in noise generation in rolling traffic can be achieved by the interaction of a plurality of features in the design of paving slabs or concrete blocks and of the earth covering produced therefrom.

A considerable contribution to the sound absorption is achieved by the upper cross-sectional area of the concrete block, namely by the absorption layer of porous concrete. Paving slabs having a porous concrete coating are known in principle. In the case of this prior art, however, the function of the covering layer of porous concrete is to drain away surface water. The sound-absorbing effect of the porous concrete has not hitherto been recognised.

According to the findings forming the basis of the invention, the concrete blocks are configured in a larger format, namely plate-shaped. Dimensions exhibiting an edge length of at least 30 cm, in particular square concrete blocks having an edge length of 33 cm, have proved to be advantageous for noise reduction. In the case of these larger concrete blocks for earth covering, in order to drain off the surface water adequately, the absorption layer of porous concrete is configured on the bottom side, according to the invention, in a curved shape, so that the surface water can run off to the sides of the concrete block.

Due to the larger dimensioning of the plate-shaped concrete blocks, a special configuration of the bottom side of the same is also necessary, namely exhibiting a curvature. This results in a better load distribution over the suboil. As a result of the configuration according to the invention, the fringe areas of the concrete block are subjected to a higher load on the bottom side. This results even over a prolonged period in a stable position for the blocks.

For the further reduction of noise, it is intended that the concrete blocks according to the invention should be laid at very small distances from one another, i.e. exhibiting very narrow joints. This makes it harder for the surface water to be drained off. According to the invention, the concrete blocks are therefore equipped with upright water drainage ducts, namely slots, on the lateral surfaces. These extend directly below the absorption layer, so that the surface water from this makes its way into the upright slots and then into the subsoil.

Further features of the invention relate to details of the concrete block's configuration and to a process and device for the manufacture of the same.

BRIEF DESCRIPTION OF THE DRAWINGS

Illustrative embodiments, from which further inventive features are derived, are represented in the drawing, in which:

FIG. 6A shows a vertical section according to FIG. 5 through a traditional paving covering, FIG. 6B is a pressure diagram for the paving covering of FIG. 6A, and FIG. 7 shows a paving covering according to FIG. 6 under load from road traffic.

DESCRIPTION OF THE PREFERRED EMBODIMENTS

Figure 1:
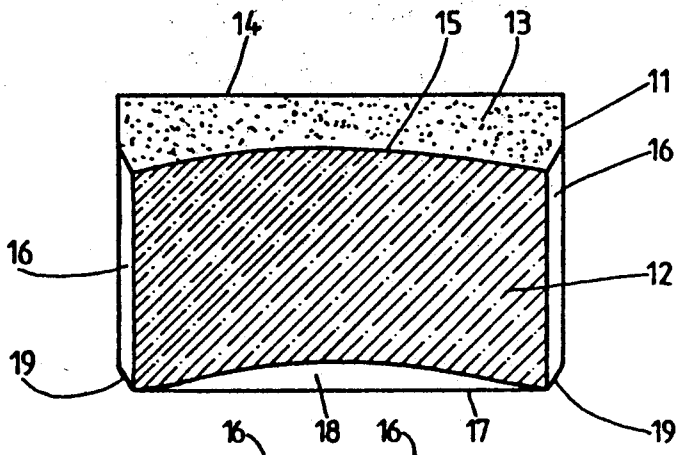
FIG. 1 shows a vertical section through a paving slab according to the invention.

FIG. 1 shows a concrete block 11 according to the invention, in vertical section.

The block 11 consists of two layers, of which the first layer is the actual block element 12 to which the second layer, an absorption layer 13 which is sound-absorbent, is applied.

The absorption layer 13 exhibits a smooth top side 14, which, in the case of a paving covering made from blocks 11, is a component part of the carriageway surface. Since the top side 14 is smooth, the rolling noise on the block 11 is reduced. The top side 14 is of sharp-edged configuration, there are therefore no bevels provided on the edges of the top side 14.

The absorption layer 13 is of porous configuration. To this end, the absorption layer 13 preferably exhibits a granulation of from 4 mm to 8 mm. This granulation is cement-bonded. The bonding can however be reinforced by additional bonding agents such as, for example, plastic, preferably polymers, or silicate.

Rainwater or other liquids could permeate into the absorption layer 13. To allow these liquids to flow away out of the absorption layer 13, the top side 15 of the block element 12, to which top side the absorption layer 13 is applied, is of convex configuration. It thus exhibits a dome shape, so that water or other liquids on this top side 15 flow away from the middle out to the fringes. In its fringe areas, the block 11 exhibits vertical slots 16 made in the lateral surface, through which slots the liquid can flow away from the top side 15 of the block element 12 to the bottom side of the block 11 and can then seep away in the ground.

The slots 16 extend only from the bottom side 17 of the block 11 up to the absorption layer 13, i.e. they do not run through the absorption layer 13. This means that the edges of the top side 14 remain sharp-edged all the way round, i.e. no openings are present in the fringe areas of the top side 14. Thus, paving slabs for the formation of a road covering can lie adjacent to one another exhibiting a narrow joint or virtually without a gap, thereby producing a virtually jointless carriageway surface on which the rolling noises of the traffic are minimised.

Although the block 11 is represented in FIG. 1 as somewhat compact, it is preferably configured in a plate-shape exhibiting the maximum possible surface area. Blocks 11, the edge length of which (in plan form) amounts to at least 30 cm, have proved to be favourable. Optimal results are achieved in the case of a block 11 which is of square configuration and has an edge length of 33 cm. In order to achieve an optimal seating of the block 11 on a paving base, the block 11 exhibits on its bottom side 17 a concave curvature 18. In the fringe areas of the bottom side 17, circumferential bevels 19 are configured, which are of relatively steep configuration.

Figure 2:
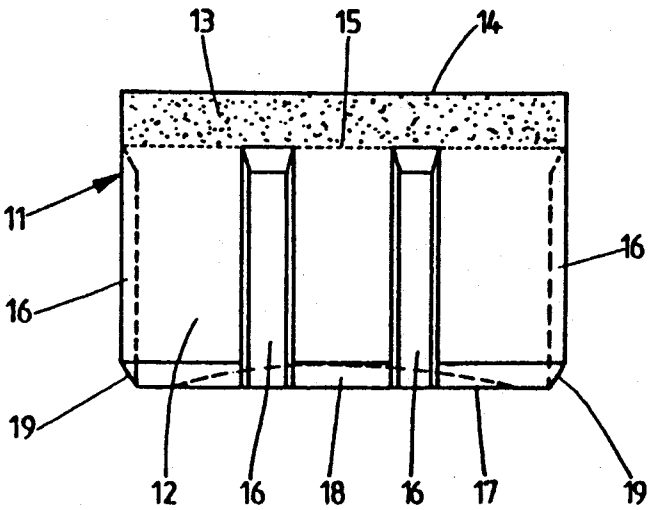
FIG. 2 shows a side view of the paving slab as represented in FIG. 1.

FIG. 2 shows a side view of the block 11 according to the invention as represented in FIG. 1. Identical structural elements are designated in FIG. 2, as also in the other figures, with the same reference numerals as in FIG. 1.

From FIG. 2, the configuration of the slots 16, in particular, is once again visible from a different view.

Figure 3:
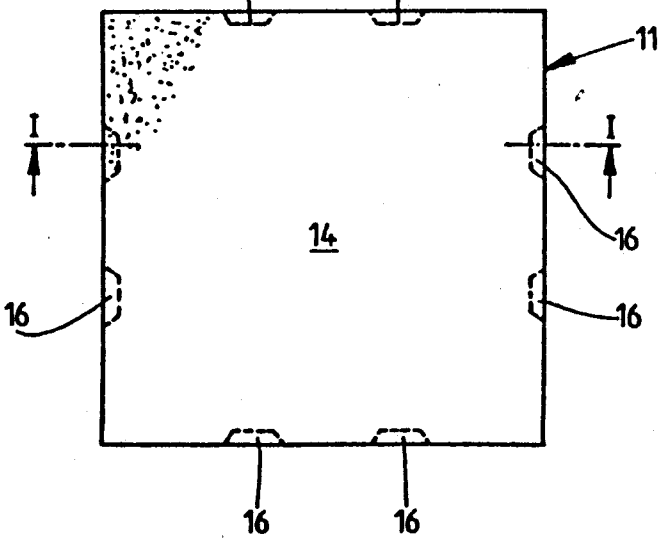
FIG. 3 shows a top view onto the paving slab as represented in FIGS. 1 and 2.

FIG. 3 shows the block 11 according to FIGS. 1 and 2 in the top view. For the sake of clarity, the porous top side 14 is only indicated in FIG. 3 by a dotted line in a corner area. From FIG. 3, the arrangement of the slots 16 on the lateral surfaces of the block 11 can be ascertained.

Figure 4:
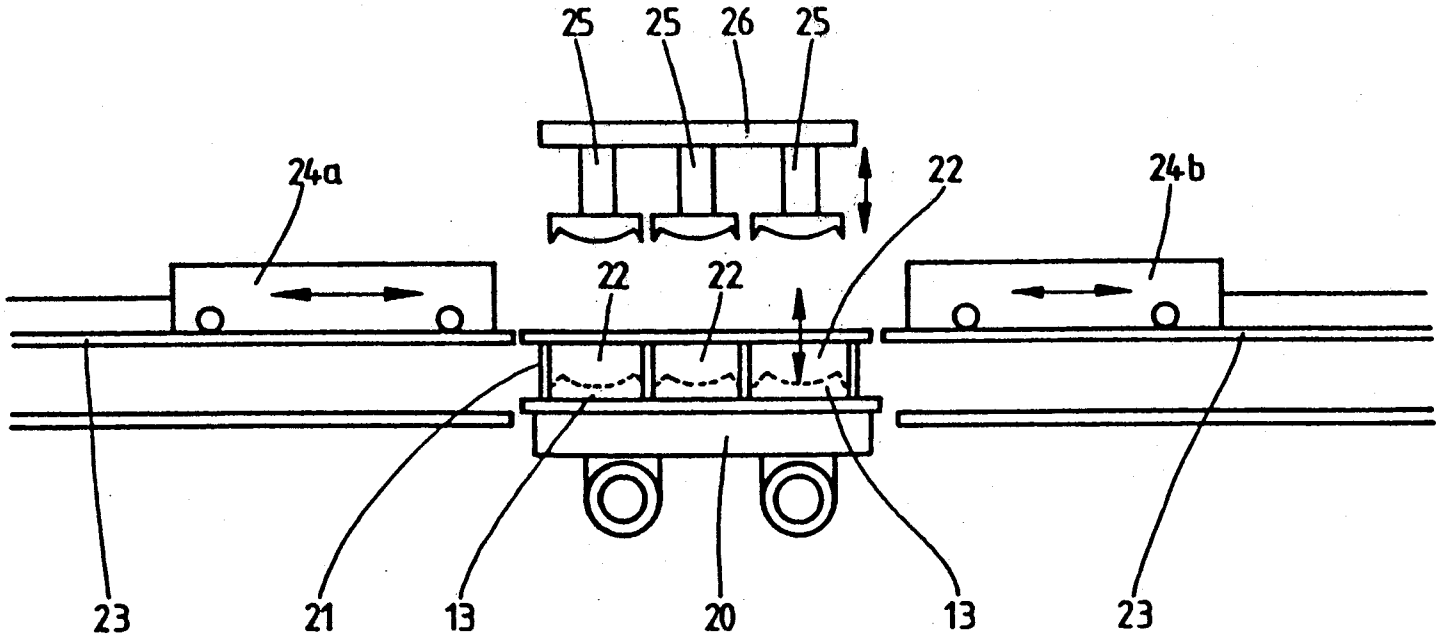
FIG. 4 shows a diagrammatic side view of a production plant for the manufacture of a paving slab according to the invention as represented in FIGS. 1 to 3.

FIG. 4 shows a production plant for the manufacture of blocks 11 according to FIGS. 1 and 3, in a diagrammatic side view.

The production plant comprises a jolting table 20, on which is disposed a moulding box 21 having moulds 22 for the shaping of blocks 11 according to the invention. This moulding box 21 can be jolted by the jolting table 20, as indicated by a double arrow, in an upward and downward motion.

The production plant further comprises two filling trolleys 24*a, b*, which can be moved on rails 23 and in which the two charges for the manufacture of the two layers 13 and 12 of a block 11 are stored. At least the filling trolley 24*a* which takes up the ancillary charge for the production of the absorption layer 13 has a metering system for the metered pouring in of ancillary charges for the formation of absorption layers 13 into the moulds 22.

Above the jolting table 20 are disposed moulding dies 25 which can be lowered into the moulds 22. The moulding dies 25 are suspended from a tie-bar 26 and can be moved up and down hydraulically, for example.

For the manufacture of blocks 11 by means of the production plant, an ancillary charge is first poured into the moulds 22 and shaped, by lowering of the moulding dies 25 into the moulds 22, to form absorption layers 13. After that, the core charge for the formation of block elements 12 is poured into the moulds 22. These are then similarly shaped by lowering of the moulding dies 25 and compressed by jolting effected by the jolting table 20.

Figures 5A, 5B:
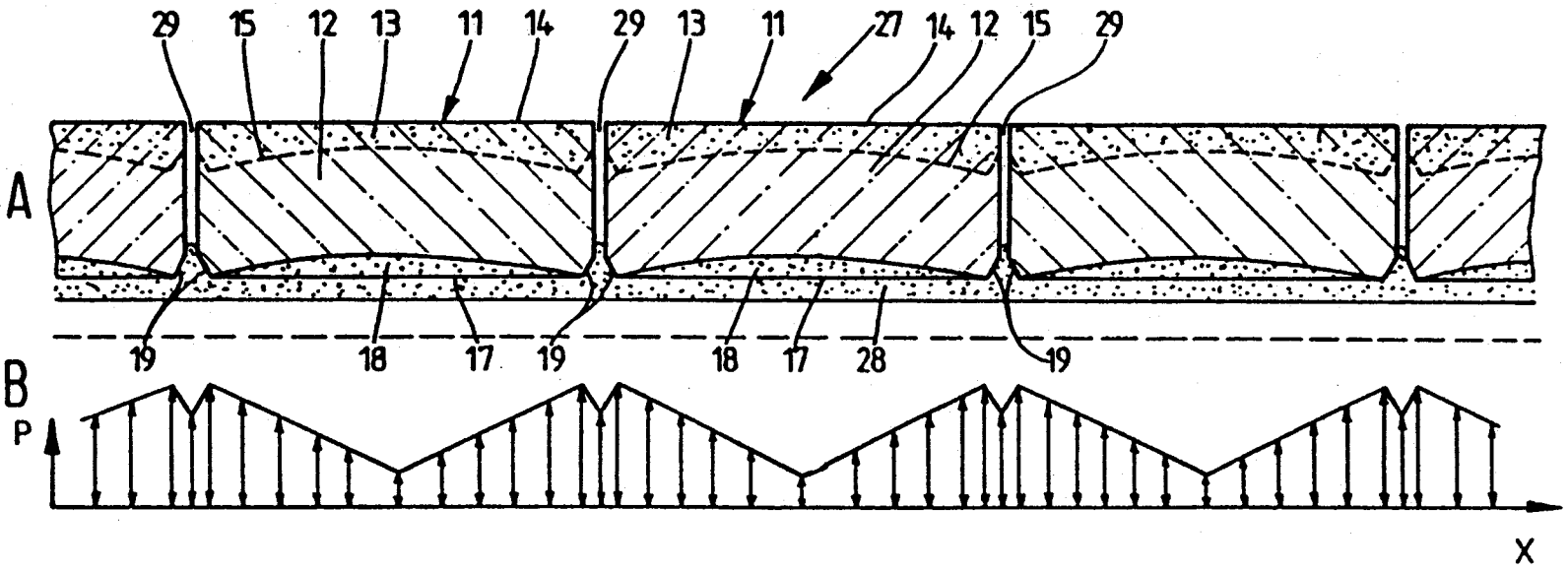
FIG. 5A shows a vertical section through a road covering produced from paving slabs according to the invention as represented in FIG. 1.
FIG. 5B is a pressure diagram for the road covering shown in FIG. 5A.

In the moulds 22, the blocks 11 are thus manufactured having their top side 14 downwards. The configuration of a sharp-edged top side 14 is guaranteed. FIG. 5A shows a road covering 27 produced from blocks 11 according to the invention, in a vertical section.

In FIG. 5A, it can be seen how the material 28 of a paving base penetrates into the curvatures 18 of the blocks 11 and into the joints 29 between two blocks 11. For diagrammatic reasons, the joints 29 between two blocks 11 are indicated in an exaggeratedly wide form in the representation of FIG. 5A. The blocks 11 according to the invention can be laid next to one another in a substantially more narrow-jointed manner.

Due to their specially configured bottom side 17, the blocks 11 have a particularly fixed position on the material 28 of the paving base. In particular, the fringe areas of the bottom side 17 between the bevels 19 and the curvature 18 bear down firmly on the material 29.

Beneath the representation of the road covering 27 in FIG. 5A, the pressure pattern (FIG. 5B) is indicated, i.e. the pressure P, by which the individual areas of the bottom sides 17 of the blocks 11 bear down, over a space coordinate X, on the material 29.

As a comparison to this, a vertical section through a traditional road covering 30 is represented in FIG. 6A. This road covering 30 consists of traditional paving slabs 31.

Beneath the representation of the traditional road covering 30 of FIG. 6A, the pressure pattern P—X of the traditional road covering 30 has been indicated in FIG. 6B. It can be seen that it is through their central areas that the traditional paving slabs 31 bear down with the greatest pressure on the material 32 of a paving base. This results in the traditional paving slabs 31, whenever they are subjected to traffic load, being set into a rocking motion, as has been indicated in FIG. 7. When this occurs, material 32 from the fringe areas of the bottom sides of the paving slabs 31 is partly forced under the middle of the paving slabs 31 and is partly pumped up through the joints 33 between the paving slabs 31. As a result of this, the pressure pattern indicated in FIG. 6 becomes even more extreme, so that the rocking effect indicated in FIG. 7 grows increasingly worse and the paving slabs increasingly lose their hold. Paving slabs 31 which rock in this way intensify the driving noise of vehicles even more.

In FIG. 7, an indicated wheel of a motor vehicle is designated by the reference numeral 34.

In addition, it can be ascertained from FIGS. 6A and 7 that the traditional paving slabs 31 exhibit, in the edge areas of their top sides, bevels 35, which widen the joints 33 and hence also increase the driving noise of vehicles.

I claim:

1. Plate-shaped concrete block for covering roads, paths and squares, characterised by the following features for the reduction and absorption of sound caused by rolling traffic:

a) a sound-absorbing absorption layer (13) of porous concrete is disposed on a block element (12) made from concrete, b) a top side of the absorption layer (13) is level, a bottom side of the absorption layer and, accordingly, a top side of the block element (12) are of curved configuration, the absorption layer (13) exhibiting greater thickness at fringes of the block, c) the block element (12) is equipped on a bottom side thereof with a curvature (18), such that the concrete block is configured to exhibit a greater height at the fringes of the block.

2. Concrete block according to claim 1, characterised in that the absorption layer (13) exhibits a granulation of from about 4 mm to 8 mm.

3. Concrete block according to claim 1 or 2, characterised in that the block has an edge length of at least 30 cm, and in that the absorption layer (13) is about 30 mm thick.

4. Concrete block according to claim 1, characterised in that the absorption layer (13) is spherically curved on its bottom side when the top side of the block element (12) is of convex configuration.

5. Concrete block according to claim 1, characterised in that, for water drainage purposes, lateral surfaces of the block (11) exhibit laterally open, approximately upright running slots (16), which extend from the bottom side of the absorption layer (13) to a bottom side (17) of the block (11).

6. Block according to claim 1, characterised in that edges on a bottom side (17) of the block (11) exhibit bevels (19) which run all the way round.

7. A process for the manufacture of concrete blocks for covering roads, paths and squares, wherein each block is plate-shaped and is characterized by the following features for the reduction and absorption of sound caused by rolling traffic:

a) a sound-absorbing absorption layer (13) of porous concrete is disposed on a block element (12) made from concrete, b) a top side of the absorption layer (13) is level, a bottom side of the absorption layer and, accordingly, a top side of the block element (12) are of curved configuration, the absorption layer (13) exhibiting greater thickness at fringes of the block, c) the block element (12) is equipped on a bottom side thereof with a curvature (18), such that the concrete block is configured to exhibit a greater height at the fringes of the block;

said process characterised in that the block (11) is shaped, having its top side (14) downwards, in a mould (22), an ancillary charge for the formation of the absorption layer (13) being first poured into the mould (22) and, following on from this, a core charge for the formation of the block element (12).

8. Process according to claim 7, characterised in that the ancillary charge is shaped in the mould (22) prior to the filling of the core charge, on the bottom side of the absorption layer (13) facing towards the block element (12) and pointing upwards, by an appropriately configured moulding die (25) which is lowered into the mould (22).

9. Process according to claim 7 or 8, characterised in that the core layer (block element 12) is shaped by a moulding die (25) which is lowered into the mould (22), and in that, following the lowering of the moulding die (25), the charge in the mould (22) is compressed by jolting.

10. A plant for the manufacture of concrete blocks for covering roads, paths and squares wherein each block is plate-shaped and is characterized by the following features for the reduction and absorption of sound caused by rolling traffic:

a) a sound-absorbing absorption layer (13) of porous concrete is disposed on a block element (12) made from concrete, b) a top side of the absorption layer (13) is level, a bottom side of the absorption layer and, accordingly, a top side of the block element (12) are of curved configuration, the absorption layer (13) exhibiting greater thickness at fringes of the block, c) the block element (12) is equipped on a bottom side thereof with a curvature (18), such that the concrete block is configured to exhibit a greater height at the fringes of the block;

said plant being for the execution of a process characterized in that the block is shaped having its top side (14) downwards, in a mould (22), an ancillary charge for the formation of the absorption layer (13) being first poured into the mould (22) and, following on from this, a core charge for the formation of the block element (12);

said plant comprising a table on which one or more moulds (22) for the shaping of paving slabs (11) can be disposed, and storage containers for an ancillary charge and for a core charge, from which the charges for the formation of a twin-layer paving slab (11) can be poured into the moulds (22).

11. The concrete block according to claim 3, wherein the block is square, and wherein the edge length is 30 cm.

* * * * *